United States Patent [19]

Pastrano

[11] Patent Number: 4,955,841

[45] Date of Patent: Sep. 11, 1990

[54] DISC-SHAPED THROWING TOY

[76] Inventor: Anthony Pastrano, 3131 W. Lambright, Tampa, Fla. 33614

[21] Appl. No.: 432,384

[22] Filed: Nov. 3, 1989

[51] Int. Cl.[5] ..... A63H 27/00; A63H 33/18

[52] U.S. Cl. ..... 446/46; 273/58 R; 273/424; 446/487

[58] Field of Search ..... 446/46, 488, 486, 80, 446/34, 487; 273/424, 428, 58 R, 58 D

[56] References Cited

U.S. PATENT DOCUMENTS

| | | | |
|---|---|---|---|
| 2,952,460 | 9/1960 | Ellis | 446/486 X |
| 3,758,985 | 9/1973 | Heisler | 446/46 |
| 4,790,714 | 12/1988 | Schnapp | 446/486 |

FOREIGN PATENT DOCUMENTS

| | | | |
|---|---|---|---|
| 111666 | 6/1985 | Japan | 273/58 R |

*Primary Examiner*—Mickey Yu

*Attorney, Agent, or Firm*—A. W. Fisher, III

[57] ABSTRACT

A disc-shaped throwing toy includes a collapsible shell cooperatively formed by a plurality of segments coupled between a first and second center element and at least one elastic element coupled between at least two of the plurality of segments, each of the plurality of segments includes a first and second segment member operatively coupled together by a hinge wherein corresponding first and second segment members are selectively movable between a first or collapsed position and second or expanded position relative to each other such that as disc-shaped throwing toy with the corresponding first and second segment members in the first or collapsed position relative to each other is thrown the centrifugal force initially maintains the disc-shaped throwing toy in a substantially flat configuration and as the rotational speed of the disc-shaped throwing toy decreases the elastic element causes the corresponding first and second segment elements to move to the second or expanded position relative to each other whereby the disc-shaped throwing toy forms a substantially spherical configuration.

8 Claims, 3 Drawing Sheets

DISC-SHAPED THROWING TOY

BACKGROUND OF THE INVENTION

1. Field of the Invention

A throwing toy comprising a collapsible shell formed by two symmetrically formed halves in combination with an elastic element coupling opposite sides thereof such that when the throwing toy is thrown the initial centrifugal force maintains the throwing toy is a substantially flat configuration and as the throwing toy looses rotational speed the elastic element draws the sides toward each other to form a ball-like configuration.

2. Description of the Prior Art

Numerous disc-shaped toys have been developed. Generally these toys are formed in the shape of large saucers with enlarged edges. These edges may include an extension in a plane normal to the central section to define an upper, convex surface and a lower concave surface. When the toy is hurled into the air with a rotational motion the toy exhibits aerodynamic properties to prolong flights and create true trajectories. However, the maneuvers that can be imparted to such toys are restricted due to fixed configuration.

U.S. Pat. No. 3,758,985 discloses a discus toy comprising a hollow disc supporting a pair of inflatable members. Air scoops are formed on the periphery of the disc so that when the disc is thrown the inflatable members will expand into a sphere.

U.S. Pat. No. 4,115,946 teaches a discus-like toy formed of cloth having a gathered and downturned hemmed edge having a plurality of small metallic weights fixed therein. When hurled with a rotational motion the centrifugal force acting on the weights extends the device so that it exhibits aerodynamic properties to prolong its flight and create a true trajectory.

U.S. Pat. No. 4,790,714 discloses a collapsible and expandable toy. Each side wall is provided with an inwardly extending tongue connected by elastic bands which pull the wall back from their folded position into planar state as soon as the pressure on the top is released.

U.S. Pat. No. 4,246,720 shows an attachment for a flying disk toy has a plurality of cantilevered radial vanes extending over the upper surface of the disk toy and flexing toward and away from the upper surface in fluttering movements during flight.

U.S. Pat. No. 4,425,734 teaches a flying saucer type toy. A flat disc is provided with a plurality of spiral through-cuts to define spiral blade members therebetween. The center of the disc is raised relative to the rim so that the blade members extend between the planes of the disc center and rim to provide lift when the disc is spun about an axis perpendicular to the disc.

U.S. Pat. No. 4,832,652 discloses a plastic film including indicia stretched over a continuous elastic circular member to form a planar toy. A player holds the continuous elastic circular member on opposite sides by both hands, twists the elastic circular member into a FIG. 8 shape, and then folds the elastic circular member into three overlapping portions, which configuration is retained until disturbed. When the folded toy is thrown, the toy opens to the original, flat, circular shape with a frightening sound, while simultaneously displaying the indicia.

SUMMARY OF THE INVENTION

The present invention relates to a disc-shaped throwing toy. More specifically, the disc-shaped throwing toy comprises a collapsible shell cooperatively formed by a plurality of segments coupled between a first and second center element in combination with at least one elastic element interconnected between at least two of the plurality of segments.

Each of the plurality of segments comprises a first and second segment member operatively coupled together by a hinge such that corresponding first and second segment members are selectively movable between a first or collapsed position and a second or expanded position relative to each other as described more fully hereinafter.

In use, the disc-shaped throwing toy is grasped between the thumb and one or more fingers in the first or collapsed position stretching the elastic element. The disc-shaped throwing toy is then thrown or tossed in sidearm fashion imparting a rapid rotational movement to the disc-shaped throwing toy. The initial centrifugal force is sufficient to counteract the contracting force of the elastic element to maintain the disc-shaped throwing toy in a substantially flat configuration. However as the rotational speed decreases, the contracting force of the elastic element overcomes the centrifugal force moving the corresponding first and second segment elements from the first or collapsed position to the second or expanded position relative to each other causing the disc-shaped throwing toy to form a ball-like or substantially spherical configuration.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
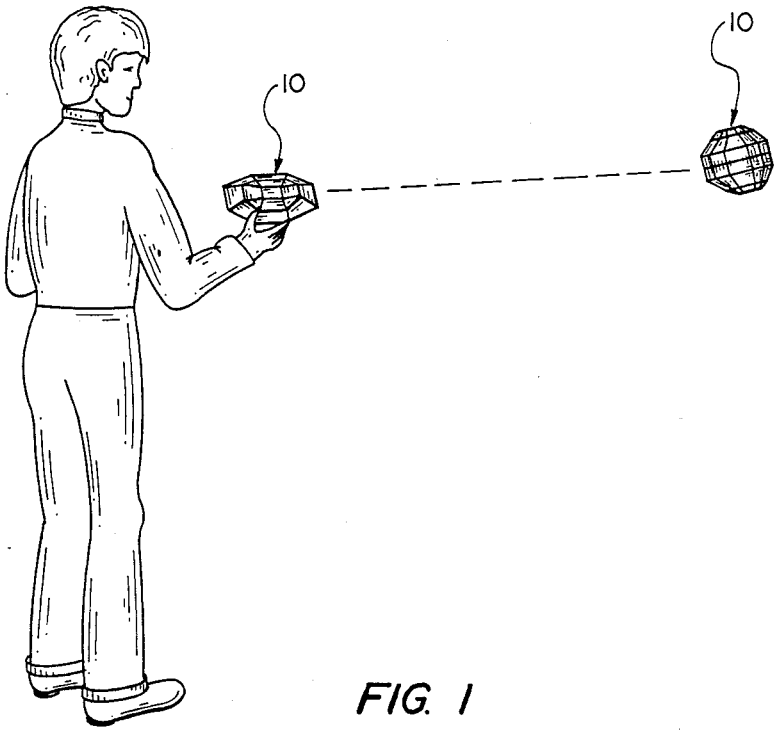
FIG. 1 is a perspective view of a person throwing or tossing the disc-shaped throwing toy.
Figure 2:
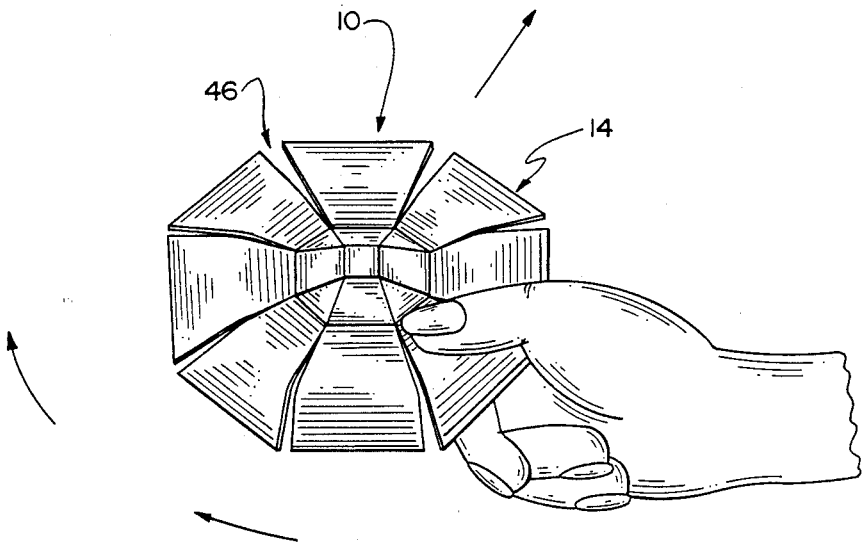
FIG. 2 is a perspective view of the disc-shaped throwing toy in the collapsed or flat configuration.

As shown in FIGS. 1 and 2, the present invention relates to a disc-shaped throwing toy generally indicated as 10.

Figure 3:
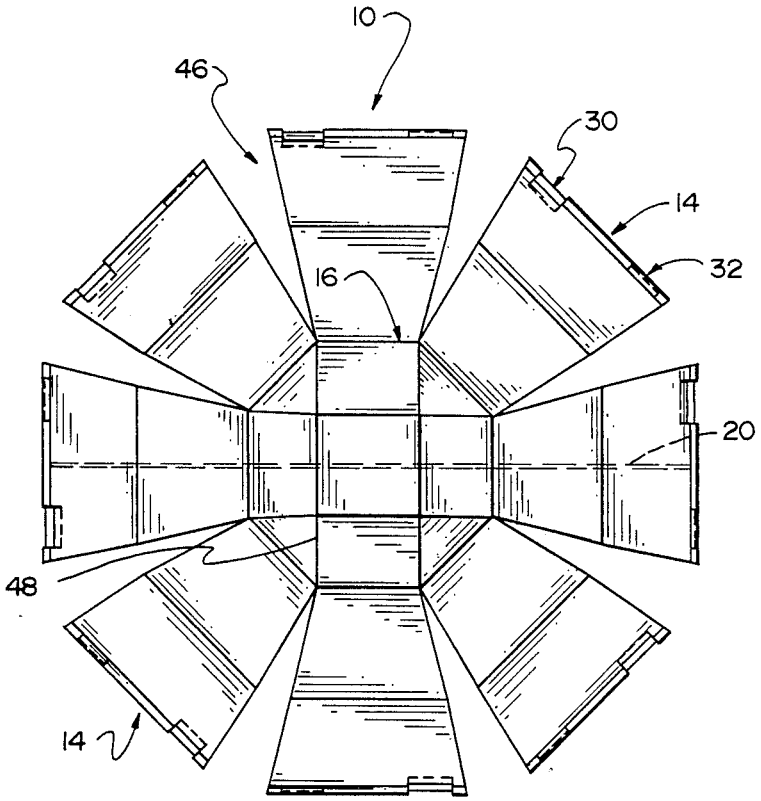
FIG. 3 is a top view of the disc-shaped throwing toy in the collapsed or flat configuration.
Figure 4:
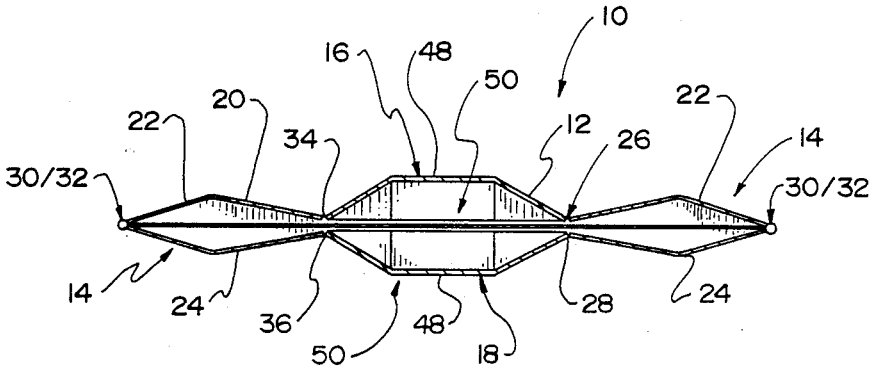
FIG. 4 is a side view of the disc-shaped throwing toy in the collapsed or flat configuration.
Figure 5:
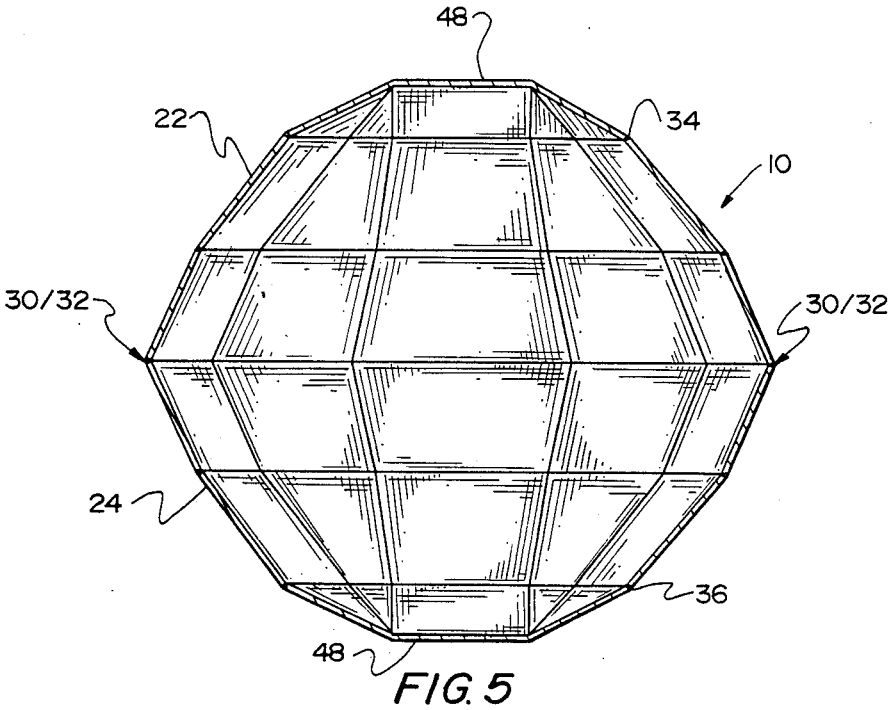
FIG. 5 is a side view of the disc-shaped throwing toy in the expanded configuration.

As best shown in FIGS. 3 and 5, the disc-shaped throwing toy 10 comprises a collapsible shell 12 cooperatively formed by a plurality of segments each generally indicated as 14 coupled between a first and second center element indicated as 16 and 18 respectively in combination with at least one elastic element 20 interconnected between at least two of the plurality of segments 14.

Figure 6:
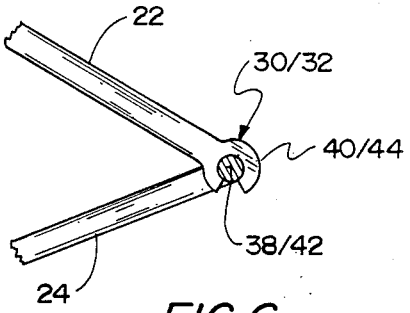
FIG. 6 is a detailed view of the hinge and interconnecting means.

Each of the plurality of segments 14 comprises a first and second convex segment member indicated as 22 and 24 respectively. The inner portions of the first and second convex segment members 22 and 24 are hingedly coupled to the first and second center elements 16 and 18 respectively by corresponding first and second inner hinges generally indicated as 26 and 28 respectively; while, the outer portions of the corresponding first and second convex segment member 22 are hingedly coupled together by a first and second outer hinge generally indicated as 30 and 32 such that the corresponding first and second convex segments 22 and 24 are selectively movable between a first or collapsed position and a second or expanded position relative to each other as described more fully hereinafter. It is envisioned that the disc-shaped throwing toy 10 will be constructed of a plastic material. When so constructed, the first and second inner hinges 26 and 28 comprise a first and second thin membrane indicated as 34 and 36 respectively interconnecting the first and second convex segment members 22 and 24 to the first and second center elements 16 and 18 respectively. As best shown in FIGS. 3 and 6, each first outer hinge 30 comprises a cylindrical member 38 and a circular seat 40 formed on the end portions of the second and first convex segment members 24 and 22 respectively; while each second outer hinge 32 comprises a cylindrical member 42 and a circular seat 44 formed on the end portions of the first and second convex segment means 22 and 24 respectively. When the disc-shaped throwing toy 10 is assembled, corresponding cylindrical members 38 and 42 are press fitted into the corresponding circular seats 40 and 44. Slots each indicated as 46 are formed between adjacent segments 14.

The first and second center elements 16 and 18 each comprises a dome shaped hexagonal rectilinear member 48 that may include a convex inner space 50.

As shown in FIGS. 1 and 2, in use, the disc-shaped throwing toy 10 is grasped between the thumb and one or more fingers in the first of collapsed position stretching the elastic element 20. The disc-shaped throwing toy 10 is then thrown or tossed in sidearm fashion imparting a rapid rotational movement to the disc-shaped throwing toy 10. The initial centrifugal force is sufficient to counteract the contracting force of the elastic element 20 to maintain the disc-shaped throwing toy 10 in a substantially flat configuration. However as the rotational speed decreases, the contracting force of the elastic element 20 overcomes the centrifugal force moving or pulling the corresponding first and second segment elements 22 and 24 from the first or collapsed position to second or expanded position relative to each other causing the disc-shaped throwing toy 10 to form a ball-like or substantially spherical configuration.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A throwing toy comprising a collapsible shell cooperatively formed by a plurality of segments coupled between a first and second center element and at least one elastic element coupled between at least two of the plurality of segments, each of said plurality of segments includes a first and second segment member operatively coupled together by a first outer hinge said first outer hinge comprises a cylindrical member formed on the end portion of said second segment member and a circular seat formed on the end portion of said first segment member to operatively receive said cylindrical member, wherein corresponding first and second segment members are selectively movable between a first or collapsed position and second or expanded position relative to each other such that as said throwing toy with corresponding first and second segment members in the first or collapsed position relative to each other is thrown the centrifugal force initially maintains the said throwing toy in a substantially flat configuration and as the rotational speed of the said throwing toy decreases said elastic element causes corresponding first and second segment members to move to said second or expanded position relative to each other whereby the said throwing toy forms a ball-like configuration.

2. The throwing toy of claim 1 wherein slots are formed between adjacent segments.

3. The throwing toy of claim 1 further including a second outer hinge comprising cylindrical member formed on the end portion of said first segment member and a circular seat formed on the end portion of said second segment member to operatively receive said cylindrical member.

4. The throwing toy of claim 1 further including a first and second inner hinge coupling said first and second segment members to said first and second center elements respectively.

5. The throwing toy of claim 4 wherein said first and second inner hinge comprise a first and second thin membrane respectively.

6. The throwing toy of claim 1 wherein said shell is disc-shaped.

7. The throwing toy of claim 1 wherein said first and second center elements each comprises a rectilinear periphery.

8. The throwing toy of claim 7 wherein said rectilinear periphery is hexagonal in shape.

* * * * *